US006189889B1

(12) United States Patent
Yip

(10) Patent No.: US 6,189,889 B1
(45) Date of Patent: Feb. 20, 2001

(54) PORTABLE BACKSTOP DEVICE

(76) Inventor: Sam Yip, 169 Barbara Pl., Middlesex, NJ (US) 08846

( * ) Notice: Under 35 U.S.C. 154(b), the term of this patent shall be extended for 0 days.

(21) Appl. No.: 08/642,475

(22) Filed: May 3, 1996

(51) Int. Cl.[7] ..... A63B 63/00

(52) U.S. Cl. ..... 273/348; 273/398; 273/410; 473/460

(58) Field of Search ..... 473/421, 431, 473/422, 435, 454, 455, 107, FOR 103, FOR 104, 456, 515, 460, 475, 491, 494, FOR 116; 273/162, 159, 348, 398, 400, 402, 410, 127 R, 127 B

(56) References Cited

U.S. PATENT DOCUMENTS

| | | | | |
|---|---|---|---|---|
| 469,554 | | 2/1892 | Favor | 473/454 |
| 1,142,184 | * | 6/1915 | Lawrence | 473/454 |
| 3,194,556 | * | 7/1965 | Vinson | 473/436 |
| 4,118,028 | * | 10/1978 | Larkin | 473/456 |
| 4,254,952 | * | 3/1981 | Playter | 473/456 |
| 5,333,856 | * | 8/1994 | Gery | 473/454 |
| 5,527,032 | * | 6/1996 | Coleman | 473/454 |

* cited by examiner

*Primary Examiner*—Jeanette Chapman
*Assistant Examiner*—Mitra Aryanpour
(74) *Attorney, Agent, or Firm*—Arthur L. Plevy; Buchann Ingersoil PC

(57) ABSTRACT

A portable backstop device for enabling an individual to practice throwing and pitching baseballs without a catcher. The backstop device includes a front panel and a back panel which are attached to each other to form a backstop member. A portion of the back panel extends beyond a bottom edge of the front panel, so that the portion can be folded such that a bottom edge of the portion of the back panel can be detachably connected to the bottom edge of the front panel to define a pocket for collecting thrown and pitched baseballs. A rectangular shaped aperture formed in the front panel of the portable backstop member enables an individual to practice throwing balls and strikes without an umpire. Balls entering the aperture are collected in the pocket thus, saving time and energy spent in retrieving the thrown baseballs and also substantially prevents the baseballs from getting scuffed from hitting backfences and the like. Additionally, a ball hitting any portion of the front panel will also fall into the pocket without rebounding dangerously.

3 Claims, 2 Drawing Sheets

PORTABLE BACKSTOP DEVICE

FIELD OF INVENTION

The present invention relates generally to sports accessories, and more particularly to a portable ball collecting backstop device for throwing, pitching and target practice.

BACKGROUND OF THE INVENTION

The prior is replete with various types of backstop devices which allow an individual to practice pitching and throwing baseballs by his or herself. For example, U.S. Pat. No. 5,088,740 entitled PRACTICE BACKSTOP FOR BALL PLAYING SPORTS issued on Feb. 18, 1992 to Peterson describes a practice backstop which consists of a flexible target sheet supported within a frame-like enclosure. The frame-like enclosure is comprised of a pair of crossed arcuate poles covered by a three sided enclosure that is open in the front. The flexible target is supported within the enclosure so that it can be struck by and absorb the impact of balls pitched or thrown at the backstop. The enclosure can include a floor surface and a series of fasteners for supporting the target sheet at various front to back spaced apart positions within the enclosure.

U.S. Pat. No. 5,242,160 entitled PORTABLE BACKSTOP issued on Sep. 7, 1993 to Girard et al. describes a foldable backstop device. The backstop comprises an inverted U-shaped frame that stands vertically on a pair of legs. The inverted U-shaped frame is supported on a planar base member. A U-shaped frame is pivoted from an intermediate point of the legs of the inverted U-shaped frame. When the backstop is unfolded for use, the U-shaped frame extends outward from the inverted U-shaped frame. A bag-shaped mesh net is attached around the upper perimeter of the frames and forms a combination back stop element and pocket for receiving balls thrown at the net. The U-shaped frame folds upward against the inverted U-shaped frame for transportation and storage.

U.S. Pat. No. 5,333,856 entitled PITCHING PRACTICE APPARATUS issued on Aug. 2, 1994 to Gery describes backstop device with a pitching strike zone. The device comprises a backstop member fabricated from canvas or netting material attached to a main frame member. The backstop member is provided with a generally flaccid strike zone member which forms a pouch that may be stretched by an auxiliary tensioning unit. A strike zone obscuring unit is also provided for selectively adjusting the upper and/or lower portions of the strike zone opening in the backstop member.

A problem common to all of these backstop devices is the heavy and bulky mounting frame they employ which makes transportation, setup and storage of these devices cumbersome for adults and virtually impossible for small children. Further, the mounting frame increases the cost of these devices.

Accordingly, there exists a need for an lightweight and inexpensive portable backstop device which can be easily and conveniently transported, setup and stored by either adults or children.

SUMMARY OF THE INVENTION

A backstop device for enabling an individual to practice throwing and pitching baseballs without a catcher, the backstop device comprising a planar backstop member for suspending from an overhanging support, the backstop member having a pocket disposed at a bottom thereof for collecting thrown and pitched baseballs. An aperture is defined in the backstop member, whereby the aperture provides a strike zone for pitching baseballs.

BRIEF DESCRIPTION OF THE DRAWINGS

For a detailed understanding of the invention, reference should be made to the following detailed description taken in conjunction with the accompanying drawings wherein.

DETAILED DESCRIPTION OF THE INVENTION

The portable backstop device of the invention is especially useful for enabling an individual to practice throwing and pitching baseballs at full speed without another person catching. Additionally, the portable backstop device of the invention includes an strike zone sized aperture which enables an individual to practice throwing balls and strikes without an umpire. Further, the portable backstop device of the invention includes a built in pocket for holding the thrown baseball thus, saving time and energy spent in retrieving the thrown baseballs and substantially preventing the baseballs from getting scuffed from hitting backfences and the like since all balls passing through the aperture or otherwise contacting substantially any portion of the device above the pocket will fall into the built in pocket without rebounding dangerously. Still further, the backstop device of the invention can be used either with a hitter or without a hitter and is suitable for indoor or outdoor use. Although the portable backstop device is especially intended for use with baseballs, it can also be used to catch other ball-like objects as well.

Figure 1:
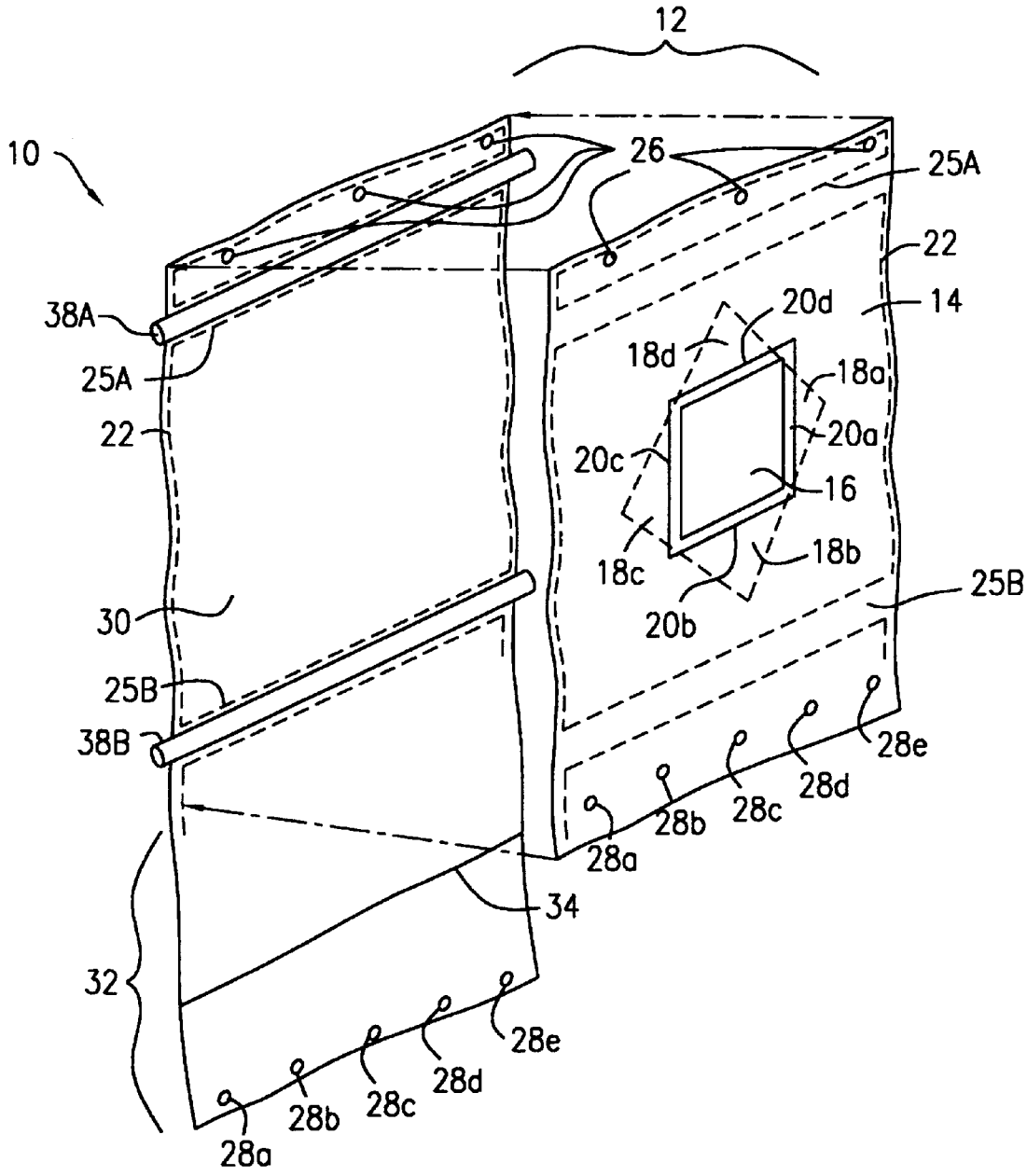
FIG. 1 is an exploded perspective view of the backstop device of the invention.

As can be seen by reference to FIG. 1, the portable backstop device of the invention is designated generally by the reference numeral (10). The backstop device 10 comprises a generally rectangular backstop member 12 including a front panel 14 and a back panel 30. The front and back panels 14 and 30 are made from any suitable cloth-like material such as canvas or nylon. In other embodiments of the invention, the front and back panels 14 and 30 can be each made from netting material or, one of the front and rear panels 14 and 30 can be made from cloth and the other can be made from netting material.

The front panel 14 of the backstop member 12 has a preferred width W1 of approximately 3 feet and a preferred length L1 of approximately 4 feet. A rectangular aperture 16 is provided in the front panel 14 as target or a strike zone. The rectangular aperture 16 has a preferred width w of approximately 14 inches and a preferred length l of approximately 16 inches. The rectangular aperture is preferably made by cutting four triangular shaped flaps 18*a–d* in the front panel 14. Next, four braided cords 20*a–d* are sewn (from the rear surface of the front panel 14) into the edges of the rectangular aperture 16 to provide a supporting frame for the rectangular aperture. Finally, each flap is folded back around a respective braided cord and sewn to the rear surface of the front panel 14 to create the rectangular aperture 16.

The back panel 30 of the backstop member 12 has a preferred width W2 of approximately 3 feet and a preferred length L2 of approximately 5 feet. The front and back panels

Figure 2:
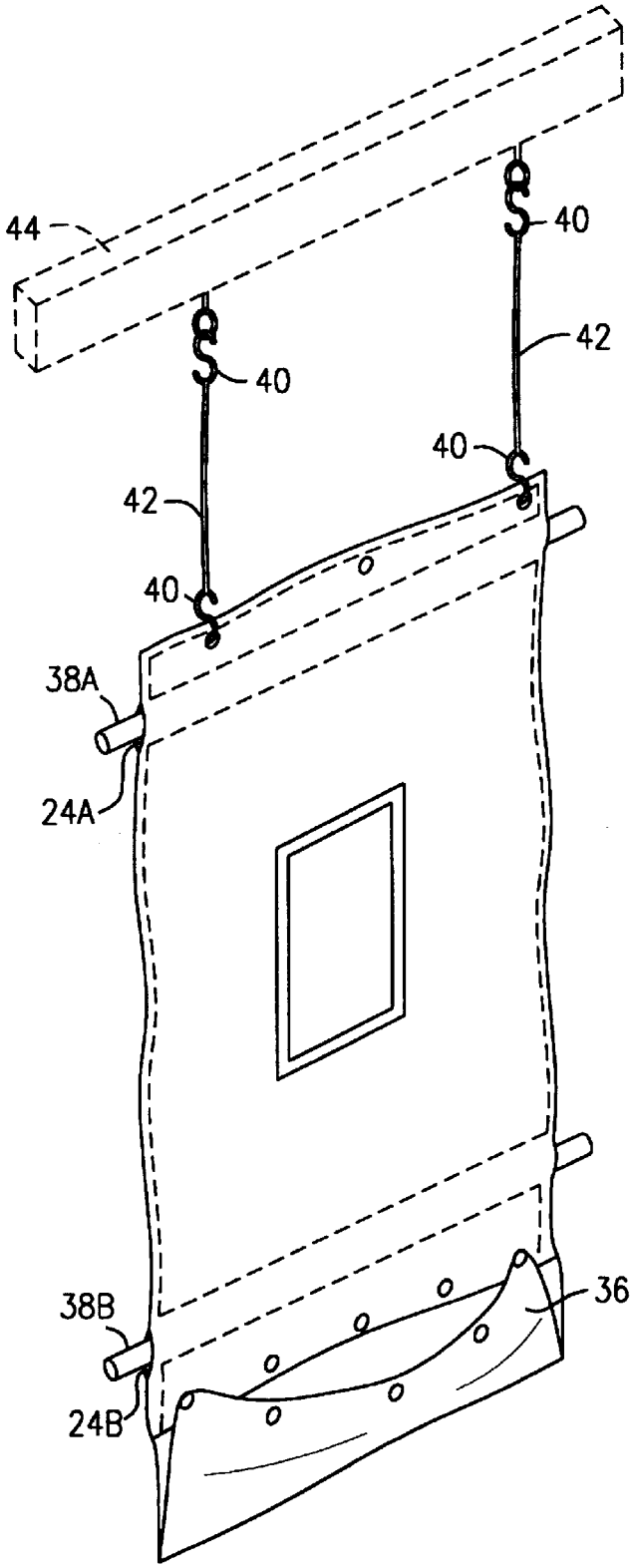
FIG. 2 is a perspective view of the backstop device of the invention showing it suspended from an overhanging support.

14 and 30 are sewn or otherwise attached together along their top and side edges by stitching 22 while the bottom edges of the front and back panels 14 and 30 remain unattached. Since the back panel 30 is longer than the front panel 14, a portion 32 of the back panel 30 extends beyond the bottom edge of the front panel 14. The extending portion 32 is folded along a fold line 34 towards the front panel 14 so that the corners of the extending back panel portion 32 can be attached to the bottom comers of the front panel 14 to create a front opening ball receiving pocket 36 as shown in FIG. 2. A plurality of snap-type fasteners 28*a–e* are provided along the bottom edges of the front and back panels 14 and 30 for attaching the corners of the extending back panel portion 32 to the front panel 14. As shown in FIG. 2, only the fasteners 28*a* and 28*e* located at the corners are required to form the ball receiving pocket 36. The fasteners 28*b–d* extending between the two corner fasteners 28*a* and 28*e* can be used for closing the pocket 36 entirely if desired.

Referring to FIG. 2, the top edge of the backstop member 12 includes a plurality of ring and grommet elements 26 for suspending the backstop device 10 by S hooks 40 and chains 42 to any suitable overhanging structure such as a tree or a beam 44. Rods 38A and 38B are provided for maintaining the structural integrity of the backstop member and can also operate as an alternate means for suspending the backstop device 10. The rods 38A and 38B are respectively disposed in channels 24A and 24B. The channel 24A is created in the backstop member 12 by sewing the front and back panels together with stitching 25A. The channel 24B is made by sewing a strip of the cloth-like material to the back panel with stitching 25B. The ends of each rod 38A, 38B extend out from respective channels 24A, 24B in the backstop member 12.

Since the backstop device 10 is made from a cloth-like material which causes it to be relatively light in weight and because the it is not associated with a holding frame, the backstop device 10 can be easily rolled up for storage and transported by either an adult or a child. To setup the backstop device 10, one merely unrolls it and connects the S hooks 40 and chains 42 to any suitable overhanging structure such as a tree or a beam. The backstop device 10 is then suspended by connecting the backstop member 12 to the S hooks by the ring and grommet elements 26. The user can now pitch or throw baseballs at full speed without having another person to catch the pitched or thrown balls. When a baseball enters the strike zone sized rectangular aperture 16 in the front panel 14, the baseball contacts the back panel 30 and falls into the pocket defined by the front and back panels 14 and 30. Accordingly, the backstop device 10 operates as an invisible umpire to call balls and strikes. The built in pocket 36 eliminates the need to retrieve the thrown baseballs and substantially prevents the baseballs from getting scuffed from hitting backfences and the like since a ball hitting any portion of the front panel 14 of the backstop member 12 above the pocket 36 will fall into the pocket 36 without rebounding dangerously. The pocket 36 can be unloaded by simply unsnapping the fasteners 28*a* and 28*e* and dumping the balls out of the pocket 36. Furthermore, raising and lowering the chains allows the strike zone to be adjusted up and down.

It should be understood that the embodiments described herein are merely exemplary and that a person skilled in the art may make many variations and modifications to these embodiments utilizing functionally equivalent elements to those described herein. For example, a foldable mounting frame can be provided for suspending the backstop device.

In any case, all such variations or modifications as well as others which may become apparent to those skilled in the art, are intended to be included within the scope of the invention as defined by the appended claims.

What is claimed is:

1. A backstop device for enabling an individual to practice throwing and pitching baseballs without a catcher, said backstop device comprising:

a front panel having an aperture, whereby said aperture provides a strike zone for pitching baseballs; and a back panel, said front panel being attached to said back panel to form a backstop member, wherein a portion of said back panel extends beyond a bottom edge of said front panel, said portion of said back panel having a bottom edge, said portion being folded such that said bottom edge of said portion of said back panel is detachably connected to said bottom edge of said front panel to define a pocket for collecting thrown and pitched baseballs.

2. The backstop device according to claim 1, wherein said backstop member includes grommet means for suspending said device from an overhanging support.

3. The backstop device according to claim 1, wherein said pocket is disposed below said aperture, whereby a baseball passing through said aperture in said front panel contacts said back panel and falls into said pocket.

* * * * *